United States Patent [19]

Purnell et al.

[11] Patent Number: 5,041,168

[45] Date of Patent: Aug. 20, 1991

[54] VALVE GUIDE

[75] Inventors: Charles G. Purnell, West Midlands; Andrew R. Baker, Lighthorn, both of England

[73] Assignee: Brico Engineering Company Limited, West Midlands, England

[21] Appl. No.: 516,703

[22] Filed: Apr. 30, 1990

[30] Foreign Application Priority Data

Sep. 27, 1989 [GB] United Kingdom ..... 8921826

[51] Int. Cl.[5] ..... C21D 1/44; C22C 38/16; F01L 3/00

[52] U.S. Cl. ..... 148/13.2; 29/888.41; 123/188 GC; 148/16.6; 148/332

[58] Field of Search ..... 148/13.2, 332, 16.6, 148/553; 123/188 GC; 29/888.41, 888.42

[56] References Cited

U.S. PATENT DOCUMENTS 3,808,659 5/1974 Alger, Jr. et al. ..... 29/888.061
4,103,662 8/1978 Kammeraad ..... 123/188 GC
4,412,873 11/1983 Hone et al. ..... 148/16.6
4,671,491 6/1987 Kuroishi et al. ..... 251/368
4,767,677 8/1988 Kuwayama ..... 428/551

FOREIGN PATENT DOCUMENTS 780073 7/1957 United Kingdom ..... 29/888.41

OTHER PUBLICATIONS

*Metals Handbook Desk Edition;* Howard Boyer and Timothy Gall, editors: American Society for Metals, Metals Park, Ohio (1985), pp. 25-1, 25-12, and 25-13.

*Primary Examiner*—R. Dean
*Assistant Examiner*—Robert R. Koehler
*Attorney, Agent, or Firm*—William R. Hinds

[57] ABSTRACT

A valve guide and a method for the manufacture thereof are described. The valve guide is a tubular article having a length to outer diameter ratio greater than about 1.5 and is made of a ferrous material by a PM route. The pressed guide is infiltrated by preparing a sheet of the infiltrant alloy, rolling the sheet into a cylinder and inserting it into the guide bore followed preferably by, simultaneous sintering and infiltration.

9 Claims, 1 Drawing Sheet

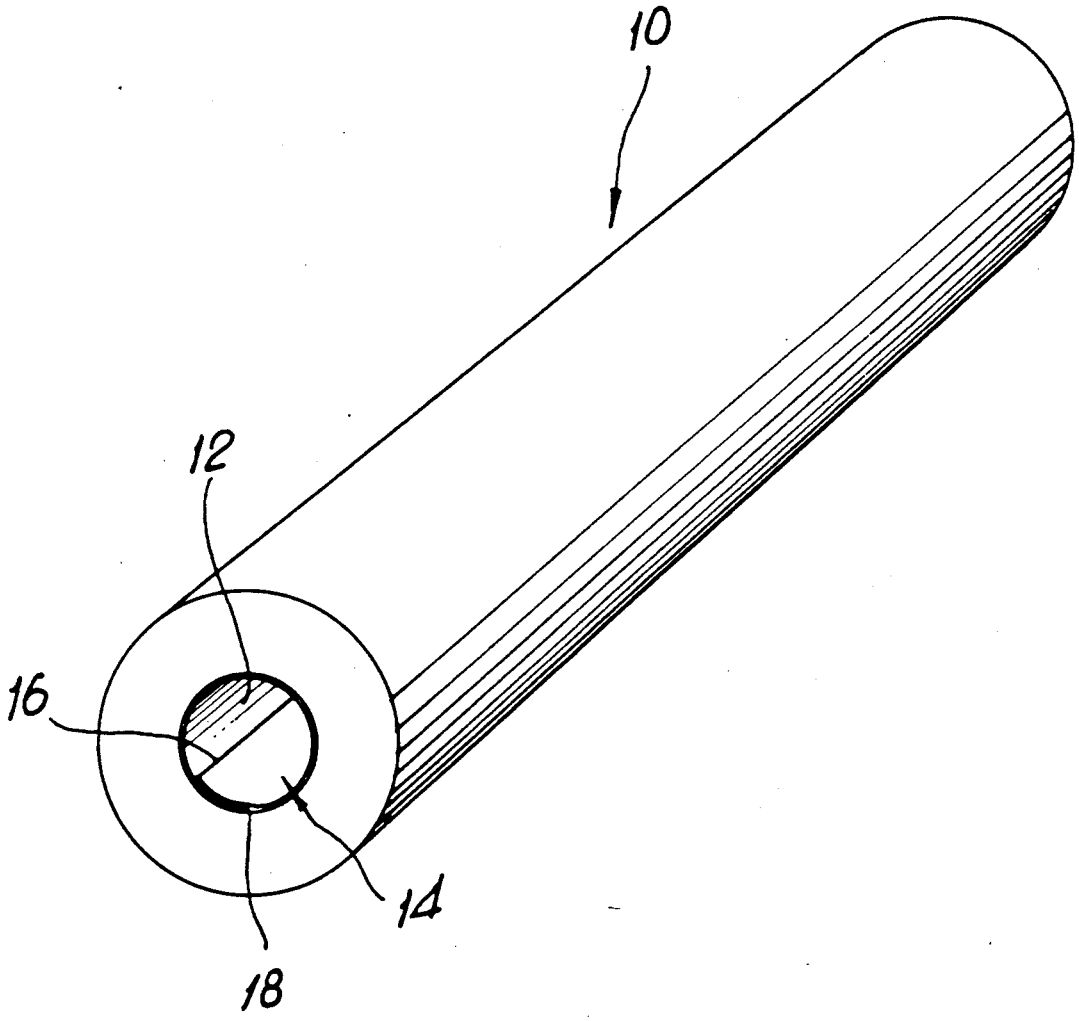
10
12
16
14
18

VALVE GUIDE

The present invention relates to valve guides for internal combustion engines and to a method of making a valve guide.

Valve guides support and align the movement of poppet valves and run under conditions of marginal lubrication with the co-operating valve stem. The valve stem can attain very high temperatures due to contact with hot combustion exhaust gases, therefore, good thermal conductivity is necessary in the valve guide material to conduct heat away to the surrounding cylinder head to minimise the maximum temperature at the valve guide bore. Too high a temperature at the valve guide bore may result in thermal softening.

Valve stems are generally made of alloy steels either plain or chromium plated. In the case of plain steel inlet valves these may be of a martensitic steel, for example 9 wt. % chromium, 4 wt. % of silicon (Silchrome—Trade Mark) steel, in the case of exhaust valves they may be of high chromium austentitic steel for example 21:4N. An inherent lubricity of the valve guide bore is, therefore, necessary. Furthermore, it is necessary that such lubricity should persist for a substantial depth from the as produced valve guide bore due to the custom of engine manufacturers to increase the bore diameter by up to 2 mm by reaming during engine assembly. This latter requirement also makes good machinability desirable in order to achieve good dimensional control, predictable surface quality and low tool wear.

A further desirable characteristic of valve guide materials is that of relatively high hardness to give compatibility with the valve stem. Such hardness may be achieved by incorporation or production of hard, wear resistant phases in the material microstructure.

The use of grey cast irons for valve guides throughout the history of the automobile has been occasioned by a combination of good thermal conductivity, (35–60 W/M/degK dependent upon alloy and temperature), reasonably high hardness resulting from pearlite and steadite microstructural constituents, and by the lubricity and good machinability afforded by the graphite in the microstructure.

Amongst other fully dense materials in use for valve guides may be mentioned free-machining tellurium-copper for low temperature inlet guides, and harder high-tensile brasses for exhaust guide applications. For these, the excellent thermal conductivity (about 250 and 100 W/m/degK respectively) and good machinability, is offset by low lubricity, relatively low hardness and low softening temperatures, which together can result in scuffing in use and premature wear.

Valve guides manufactured by a powder metallurgical (PM) route are well known, an example of such a guide is described in Poroshkovaya Metallurgiya No. 3 (147) p 93–96, March 1975 by Pozdnyak et al. Because of the nature of the metal compositions used for PM valve guides, the thermal conductivity tends to be lower, less than 30 W/m/degk. The machinability of PM valve guide materials can be poor, and the results of machining can be aggravated by variation in density within the guide, leading to inconsistent control of dimensions and of the condition of the machined bore surface. In known PM valve guides the co-operating valve stem usually requires a chromium plated surface, because of the relatively abrasive nature of the valve guide material.

One known means for improving the conductivity of PM alloys, as well as generating a more consistent material is to infiltrate the PM components with copper or copper-based alloy. Such infiltration is known, for example, in valve seat inserts where the copper also assists the machinability of the component.

There are serious problems, however, in infiltrating long, tubular PM components. Because of the geometry of the valve guide it would not be possible to infiltrate such a component by the normal techniques which usually comprise placing a copper or copper alloy PM compact on top of an outer surface of the component to be infiltrated. It would not be economically possible to stand a valve guide up on one of its ends and place a copper compact on the top and bottom due to stability and support problems; the cost of jigging and labour to do so would be prohibitive in such a component. The only reliable way to infiltrate a high aspect ratio tubular component such as a valve guide would be to place the copper infiltrant in the bore of the component. This again has serious economic implications in that the weight of the copper component must be very closely matched to the volume of the porosity in the ferrous PM component needing to be infiltrated. It would not be economic to machine copper rods, for example, even if technically possible, and even less so to machine copper tubes in order to achieve the correct weight of infiltrant. To produce drawn copper or copper alloy tubes with a wall thickness appropriate for valve guides for automobile use would be prohibitively expensive.

If the weight of copper infiltrant does not lie within relatively close limits with regard to the weight of the component to be infiltratd, several adverse effects can occur. Excess copper may cause welding together of adjacent components; excess material on the component needs to be removed by machining which again has economic implications. If insufficient copper infiltrant is present this can result in incomplete infiltration which may have an adverse effect on the performance of the guide in service and may also cause machinability problems.

We have now found a method of infiltrating a tubular component having a relatively high aspect ratio and where the weight of the infiltrant is easily controlled.

According to the present invention a method of infiltrating a tubular component having a bore and a relatively high aspect ratio comprises the steps of producing a tubular component in a ferrous material by a powder metallurgy route, the component having a density lying within a desired density range and also having interconnected porosity, preparing a sheet of a desired weight of copper or copper alloy, converting the sheet into a generally cylindrical form and of an overall diameter to fit within the bore of the tubular component, subjecting the tubular component and the fitted, cylindrical sheets to a heat treatment operation at a temperature such that the copper or copper alloy melts and infiltrates at least the portion of the tubular component adjacent the bore.

A "relatively high aspect ratio" is defined, for the purposes of this specification, as a length to outer diameter ratio of greater than about 1.5.

The heat treatment operation may be a simultaneous sintering and infiltration operation or the tubular component may have been subjected to a previous sintering operation.

For larger sizes of tubular component it may be economic to employ a copper or copper alloy tube as the infiltrant in the bore.

The rolled sheet may, if desired, be converted into a tube by means of, for example, spot welding, seam welding, soldering or lock-forming of the rolled strip. This may, for example, give advantages in handling of the rolled strip and ease of assembly into the tubular component.

An advantage of the method of the present invention is that the weight of the infiltrant may be easily controlled. Copper strip need only be cut to length, given a particular thickness and width of material; the weight of the infiltrant may be controlled such that, if desired, only the area adjacent the valve guide bore need be infiltrated. Natural spring in the copper infiltrant material when released in the bore of the PM component can serve to hold the infiltrant material in place prior to infiltration, thus simplifying handling.

A further advantage of the present invention is that ordinary, freely available copper may be used for the infiltrant since a small amount of erosion of the ferrous PM component bore is not important as this is invariably machined away when installed in the cylinder head of an internal combustion engine.

Where rolled strip is used to form the infiltrant body, the composition may be adjusted, if desired, to minimize erosion of the bore and/or to improve the sliding and wear characteristics of the infiltrated surface. In practical terms the range of alloys from which strip may be economically produced far exceeds that from which tube may economically be made.

A yet further advantage of the use of copper or copper alloy infiltration is that the running temperature of the valve guide is greatly reduced due to the improved conductivity of the matrix. The use of infiltration may allow the conductivity of the infiltrated valve guide to approach much closer to that of a conventional cast iron valve guide, which may be above 50 W/m/degK. Conductivity of known, uninfiltrated ferrous PM valve guide materials is normally much lower at about 20–30 W/m/degK.

BRIEF DESCRIPTION OF THE DRAWING

In order that the present invention may be more fully understood examples will now be described by way of illustration only with reference to the accompanying drawing which shows a schematic view of a valve guide having a rolled copper or copper based alloy foil infiltrant insert in the bore prior to sintering.

The drawing shows a valve guide 10 having an internal bore 12, extending throughout the length of the guide. Inside the bore is a piece of copper alloy sheer material rolled into a tube 14 and having overlapping ends 16 and 18. The natural spring of the material allows the rolled tube 14 to be retained in the bore during handling prior to sintering and infiltration.

EXAMPLE 1

A powder blend consisting of a high compressibility iron, 0.9 wt. % of graphite, 4 wt. % of -300 mash copper, 0.5 wt. % of a solid lubricant and 0.5 wt. % of a fugitive lubricant was pressed into cylindrical tubes of length 43.5 mm, I.D. 6.25 mm, O.D. 12.85 mm, at a pressing pressure of about 600 MPa.

Tough pitch copper strip of thickness 0.55 mm, slit to a width of 17.7 mm was rolled to a tubular section of nominal diameter 6.25 mm. The tube was cut of to 43.5 mm lengths which were inserted into the green tubular blanks described above.

For comparision, commercially available copper base infiltrant powders were used to fill the bore of others of the green tubular blanks described above, tamping to retain the copper base powder mass in the bore.

The tubular blanks were then sintered in an atmosphere of hydrogen and nitrogen at 1100 deg. C for 30 minutes. Examination of the sintered blanks showed that infiltration of the blanks which had contained the rolled copper strip was complete; microsections showed a maximum volume fraction of copper phase at the bore with some depletion towards the O.D. There was no residue at the bore and the maximum depth of erosion of the steel matrix at the bore was measured as 0.3 mm.

By contrast, the blanks packed with infiltrant powder had spilled excess powder, but more seriously, large globular copper particles and porous infiltrant residues remained adhering to the sintered blank bore preventing direct reaming of the bore surface.

Reaming of sintered blanks which had contained the rolled copper strips was conducted using a six-flute reamer without any preliminary bore cleaning. The reamed surface finish, at 1.0 micrometre Ra was considered suitable for valve guide applications. The reamed bore showed negligible relaxation along its length.

EXAMPLE 2

Tubular components having a nominal length of 51 mm, I.D of 6.2 mm and O.D of 11 mm were pressed from a ferrous based powder having a composition in wt. % within the range of: C 1.5–2.5/Cu 3–6/Sn 0.3–0.7/ P 0.2–0.5/Mn 0.1–0.5/S 0.05–0.25/Others 2 max/Fe-balance, to a density of 6.9 $Mg/m^3$.

Foils of phosphor bronze alloy Pb102(Cu-5Sn-0.3P), of thickness 0.3 mm, were rolled to a cylindrical shape to fit snugly into the bore of the green compacts, were cut to length, and were inserted into the bores of the green valve guide blanks.

The valve guide blank/infiltrant foil assemblies were sintered in a nitrogen/hydrogen atmosphere with a controlled carbon potential to prevent decarburisation of the basis alloy, for times and at temperatures to permit effective sintering and infiltration of the valve guide blank.

The sintered and infiltrated blanks had densities of greater than 7.2 $Mg/m^3$, and hardness valves over 90 HRB. The microstructures showed a well infiltrated structure with coarse carbides, fine phosphide eutectic and an enhanced level of graphite compared with the non-infiltrated alloy. There was free graphite both in the matrix structure and also within the regions of copper alloy infiltrant.

Samples of these guides were reamed to an I.D of 8.0 mm, using a twin-flute gun-reamer, giving a reamed surface roughness of 1.6 micrometres Ra. One such reamed guide underwent a scuff wear test on a rig designed to simulate valve stem/valve guide sliding abrasive wear. In the test the valve guide I.D rubbed against the valve stem cyclically, at a frequency of 1500 strokes/minute, at a temperature of 150 deg C., with an imposed load transverse to the guide/stem axis of 8.0 Kg. The test was conducted with the valve guide rubbing against a stem of plain, unplated Silchrome steel (trade mark). The valve guide survived the 1800 minute maximum test duration with no evidence of scuffing or wear, a result not achieved by any other powder metallurgical valve guide material tested, or by cast-iron valve guide materials in common use.

In further tests, such reamed guides were tested for the same duration, at a frequency of 750 cycles per minute, at ambient temperature, again with an imposed transverse load of 8.0 kg., this time against stems of plain unplated 21:4 N steel. These guides again survived with no evidence of scuffing or wear. For comparison, commonly used high-tensile brass guides exposed to the same test scuffed progressively after about 500–600 minutes of the test regime.

In all the above tests the only lubrication used was an initial coating of engine oil on the stem material, prior to testing, of a thickness that could be supported following free draining of the stem standing vertically for one hour duration.

We claim:

1. A method of infiltrating a tubular component having a bore and a relatively high aspect ratio, the method comprising the steps of producing a tubular component in a ferrous material by a powder metallurgy route, the component having a density lying within a desired density range and also having interconnected porosity, preparing a sheet of a desired weight of copper or copper alloy, converting the sheet into a generally cylindrical form and of an overall diameter to fit within the bore of the tubular component, fitting the generally cylindrical formed sheet into the bore of the tubular component, and subjecting the tubular component and the fitted, cylindrical sheet to a heat treatment operation at a temperature such that the copper or copper alloy melts and infiltrates at least the portion of the tubular component adjacent the bore.

2. A method according to claim 1 wherein the sheet formed into a cylindrical form is made into a tube by a technique selected from the group consisting of welding, soldering and lock-forming.

3. A method according to claim 1 wherein the heat treatment operation is a simultaneous sintering and infiltration operation.

4. A method according to claim 2 wherein the heat treatment operation is a simultaneous sintering and infiltration operation.

5. A method according to claim 1 wherein the tubular component receives a sintering operation prior to the heat treatment to melt and infiltrate.

6. A method according to claim 1 wherein the sheet is made of tough pitch copper.

7. A method according claim 1 wherein the sheet is made of a phosphor-bronze alloy.

8. A method according to claim 1 wherein the tubular component is a valve guide.

9. A method of infiltrating a tubular component having a bore and a relatively high aspect ratio, the method comprising the steps of producing a tubular component in a ferrous material by a powder metallurgy route, the component having a density lying within a desired density range and also having interconnected porosity, preparing a tube of copper or copper alloy, the tube having an overall diameter to fit within the bore of the tubular component, fitting the tube into the bore of the tubular component, and subjecting the tubular component and the fitted tube to a heat treatment operation at a temperature such that the tube of copper or copper alloy melts and infiltrates at least the portion of the tubular component adjacent the bore.

* * * * *